United States Patent [19]

Jones

[11] Patent Number: 4,619,637

[45] Date of Patent: Oct. 28, 1986

[54] CARTON FORMING APPARATUS

[76] Inventor: Kenneth W. Jones, 615 Quail Run, Middletown, Ohio 45042

[21] Appl. No.: 740,638

[22] Filed: Jun. 3, 1985

[51] Int. Cl.[4] ..... B31B 1/28

[52] U.S. Cl. ..... 493/175; 493/167; 493/178; 493/447; 493/466

[58] Field of Search ..... 493/175, 176, 178, 179, 493/310, 318, 319, 409, 417, 438, 443, 446, 447, 455, 456, 460, 461, 465, 466, 424–427, 429, 167, 172, 173

[56] References Cited

U.S. PATENT DOCUMENTS 2,135,409 11/1938 Munn et al. ..... 493/178

2,984,162 5/1961 Gordon ..... 493/310

3,187,646 6/1965 Monroe et al. ..... 493/310

3,611,886 10/1971 Scully ..... 493/178

*Primary Examiner*—Francis S. Husar

*Assistant Examiner*—Robert Showalter

*Attorney, Agent, or Firm*—Wood, Herron & Evans

[57] ABSTRACT

In an in-line converting machine, flat carton blanks are thrust into a rotary former. The former includes a mandrel over which the carton is partially formed as the former rotates through 180°. Thereafter, the carton is thrust off the former by a kicker bar and into a hopper where the carton nests with previously-formed cartons. The nesting cams the glued carton panels together, thereby completing the formation of the carton.

4 Claims, 7 Drawing Figures

CARTON FORMING APPARATUS

This invention relates to apparatus for forming cartons, and more particularly, the invention relates to forming apparatus for receiving a flat carton blank and forming it along preformed fold lines whereupon the blank is thrust into a hopper where its formation is completed.

The invention is an improvement upon known apparatus for making paperboard cartons such as French fry scoops having tapered walls. In such known apparatus, a web from a subpply roll is printed at a printing station. It is thereafter cut to the desired shape and scored to provide fold lines. The excess web, from the cutting operation, is stripped away at a stripping station. Glue is applied to the appropriate panels of the blank. Finally, the blank is formed into the desired shape of the carton and thrust into a hopper where the carton nests with previously formed cartons.

The last forming stage has required a vertically reciprocating mandrel. The mandrel engages the underside of a blank and thrusts it upward about 10 inches past stationary plows which break the front and back walls of the carton over the mandrel and swing the side panels toward each other. As the mandrel completes its upward stroke, it thrusts the blank into a hopper where the blank engages previously-formed cartons and nests with them. In the nesting, the panels are cammed toward each other, thereby completing the formation of the carton or scoop.

The 10 inch stroke and return requires a substantial amount of time during which the next blank must wait before being formed. Thus, the lengthy stroke of the mandrel tends to slow the machine and reduce its production capability.

An objective of the invention has been to improve the final forming operation of the machine, thus introducing greater speeds and hence higher production.

This objective of the invention is attained by providing a two-stage in-line former. The first stage includes a rotary former having two diametrically-opposed forming mandrels. The former receives a blank and rotates through 180° past arcuate stationary plows, thereby breaking the blank along its score lines to bring the blank to approximately the final shape.

In the second stage, a kicker bar thrusts the blank with about a 4 inch stroke into a hopper where the blank nests with preformed scoops to complete the formation of the carton. Meanwhile, a fresh blank is being thrust into the former. Since two diametrically-opposed mandrels are employed, there is no requirement for imparting a return stroke to the forming mandrel to pick up a fresh carton blank.

By breaking up the forming operation into two stages and thus being able to reduce the final stroke into the hopper to less than one-half the length of the mandrel stroke previously required, production on the machine can be significantly increased from 100 cartons per minute to 150–200 cartons per minute.

The objective and several features of the invention will become more readily apparent from the following detailed description taken in conjunction with th accompanying drawings in which.

Figure 6:
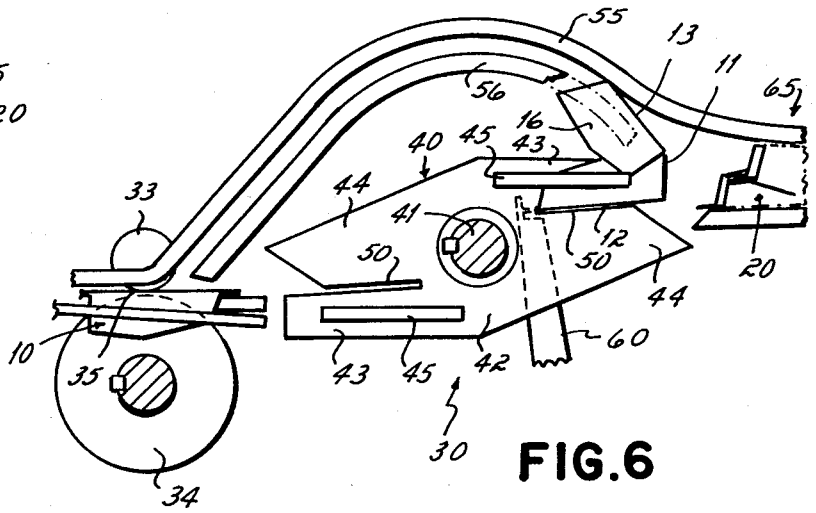
Figure 5:
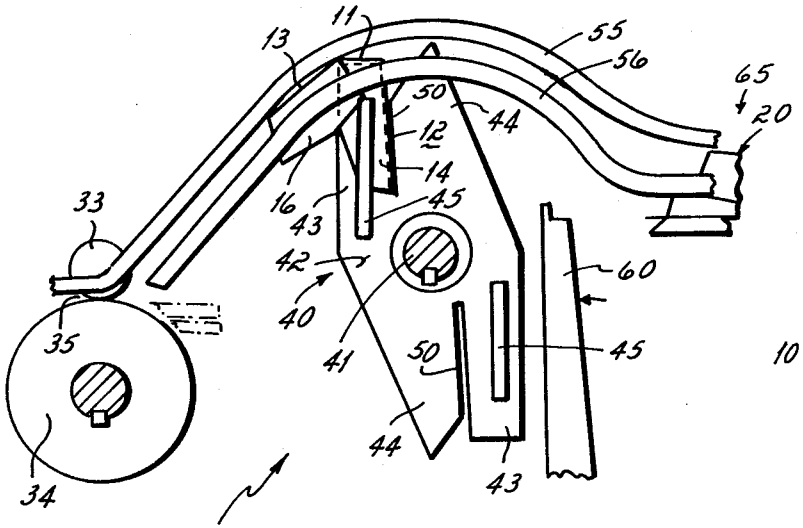
Figure 7:
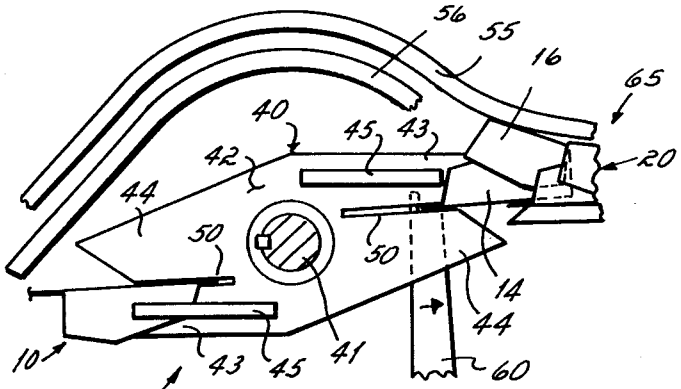

FIGS. 5, 6, and 7 are side elevational views of the former showing a sequence of operations.

Figure 1:
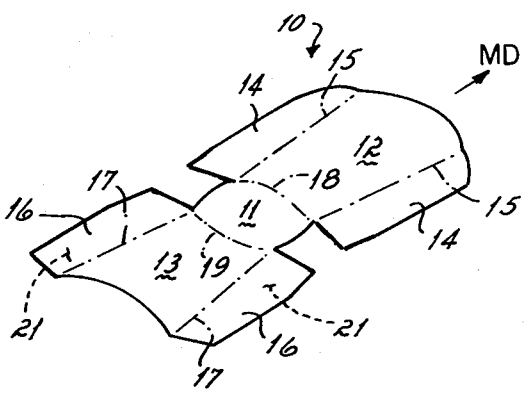
FIG. 1 is a plan view of a cut but unformed blank from which a scoop or carton is formed.
Figure 2:
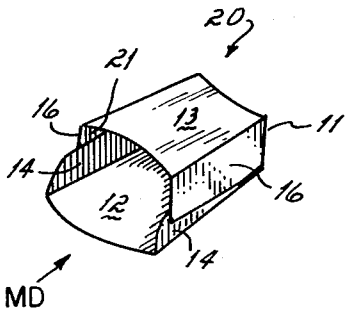
FIG. 2 is a perspective view of a scoop formed in accordance with the present invention.

Referring to FIG. 1, the French fry scoop is formed from a blank 10 having a bottom wall 11, a back wall 12 and a front wall 13. The back wall has inner panels 14 connected to it along score lines 15. The front wall 13 has outer panels 16 connected to it along score lines 17. The front and back walls are connected to the bottom walls along back score line 18 and front score line 19. The scope, when formed, appears at 20 as shown in FIG. 2. In the formation, glue had been applied to the inside surfaces 21 of the outer panels. In the formation of the scoop, the outer panels are brought into contact with the inner panels and held there until the glue sets.

Figure 3:
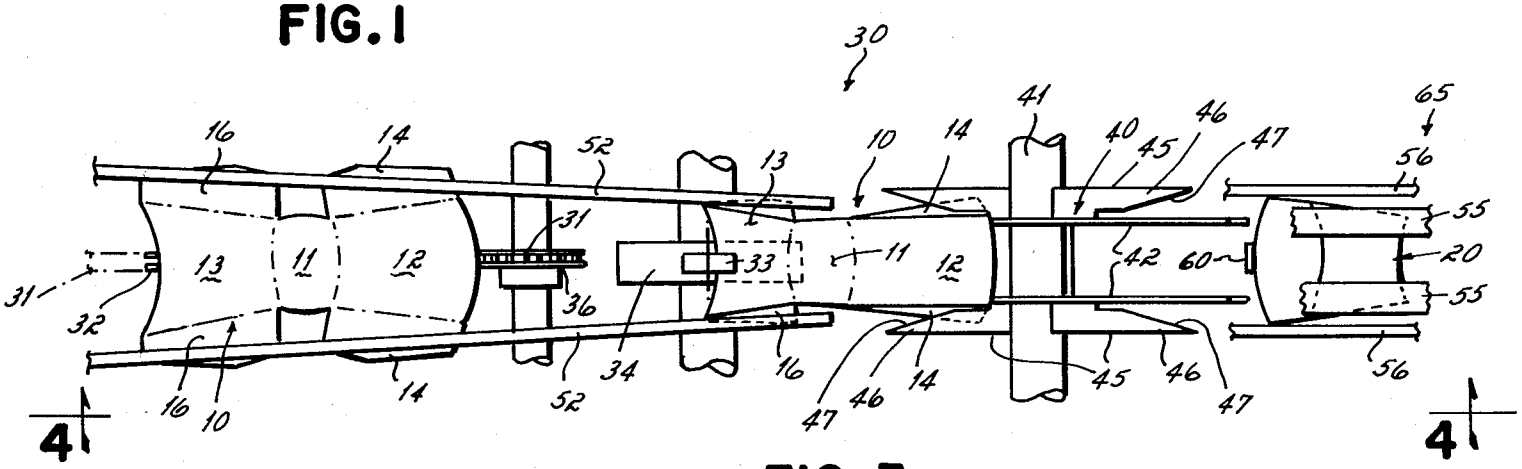
FIG. 3 is a plan view of the former of the present invention.
Figure 4:
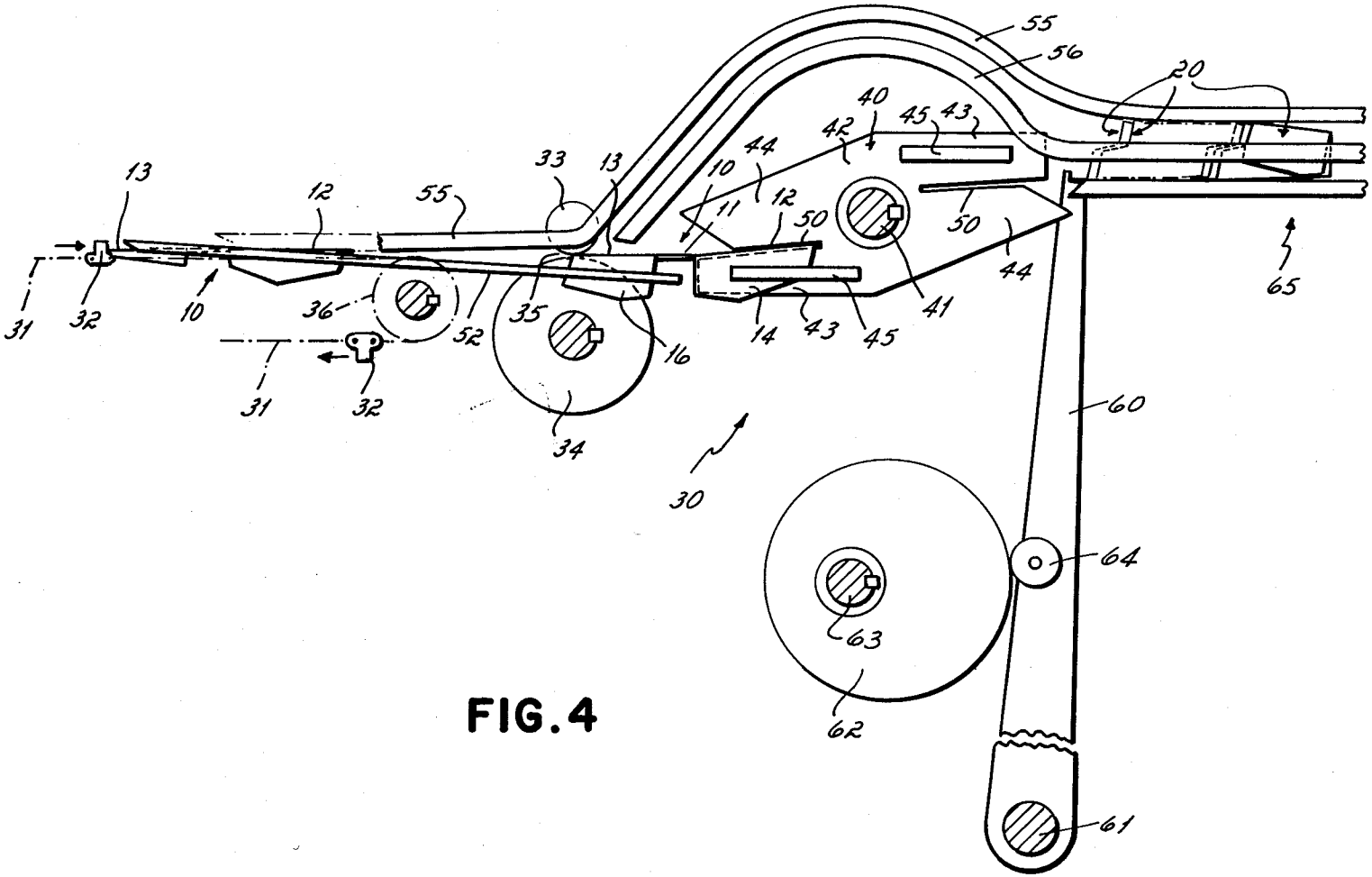
FIG. 4 is a side elevational view of the former taken along lines 4—4 of FIG. 3.

The forming apparatus is best understood by reference to FIGS. 3 and 4. The former is shown at 30. Blanks 10, previously cut and stripped from the web at upstream stations, are fed to it by means of an endless chain 31 having lugs 32 which engage the trailing edge of each blank to thrust it toward the former. The orientation of the blank could be reversed from the position illustrated. Between the former and the endless chain are a pair of rolls 33 and 34 which form a nip 35. The peripheral speed of the rollers at the nip is somewhat greater than the linear speed of the blanks being thrust by the chains 32 into the nip. Thus, when a blank is thrust into the nip, the rollers snap the blank away from the lugs 32 on the endless chain, thereby permitting the lugs to swing around the chain sprocket 36 without interference.

The former has a rotary member 40 mounted on a shaft 41. The rotary member includes two spaced plates 42 which are fixed to the shaft. Each plate has diametrically-opposed pairs of mandrel sections 43 and retainer sections 44. Each mandrel section has a side bar 45 mounted to it. Each side bar has a projecting section 46 which includes an outwardly-flaring edge 47. The mandrel section and retainer section are spaced from each other to create a slot 50 whose function it is to grasp the leading wall (back wall in the illustrated form of the invention) of the blank. Stationary side plows 52 are mounted alongside the endless chains and rollers 33, 34 to engage and fold down the panels 14 and 16. As the blank is thrust into the slot 50, the leading inner panels 14 are received by the side bars 45 and cammed down around the mandrel section.

Two pairs of arcuate plows 55 and 56 overlie the rotary member 40. The upper plows 55 engage the front wall as the former rotates through 180° and folds the front wall and bottom wall around the mandrel.

The lower plows 56 are more laterally disposed than the upper plows 55 (see FIG. 3) and engage the trailing outer panels 16 to bend them toward the inner panels as the former makes its excursion through 180° past the arcuate plows.

The shaft 41 is driven by a mechanism, not shown, which is timed to the rest of the apparatus. Preferably, a known Geneva mechanism or cam mechanism is employed to rotate the shaft 180° after a dwell for every cycle of the machine.

A kicker bar 60 is mounted for pivotal movement on a shaft 61. A cam 62 fixed to a rotating shaft 63 engages a follower 64 rotatably mounted on the kicker bar. The shaft 63 makes one revolution during each cycle of the machine and is timed to the former. As the former brings a partially-formed carton around to the downstream side of the former, the kicker bar engages the trailing edge of the carton and thrusts it into a hopper 65. As shown in FIG. 4, a plurality of cartons or scoops 20 are nested within the hopper. As each succeeding carton is thrust by the kicker bar into nesting relationship, the nesting cartons press together the paneled surfaces, thereby causing the glue on the undersurface of panels 16 to contact the outer surface of the inner panels 14 to complete the formation of the scoops.

The operation of the former can best be understood by reference to the sequence of FIGS. 4–7. As shown in FIG. 4, a flat blank has been carried by the endless chain 31 into the nip between rollers 33 and 34. Glue has previously been applied to the undersurface of trailing outer panels 16. The rollers 33 and 34 thrust the blank into slot 50 of the rotary member 40 while the rotary member is at rest during a dwell. During the movement through the nip and into the slot 50, the leading inner panels 14 are plowed down around the mandrel section 43 and enter space between the side bars 45 and the mandrel section whereupon the inner panels are held along the surface of the mandrel section.

After the blank is received in the slot 50, the former rotates through 180°. The arcuate plows 55 force the bottom wall 11 and the front wall 13 around the mandrel as shown in FIG. 5. Inner plows 56 swing the trailing outer panels 16 down toward the inner panels 14. In the meantime, the kicker bar 60 swings to the left to a postion behind the blank, as shown in FIG. 6. The former completes its 180° of rotation. The kicker bar then is pivoted to the right, engaging the trailing edge of the carton to thrust it into the hopper in a nesting relation with the previously-formed scoop. As the kicker bar is moving, a new blank is loaded into the opposite open slot 50 and the sequence of operations is ready to begin again.

As can be seen, the only limiting factor on the speed of the forming of the carton is the 4 inch stroke of the kicker bar. Since that 4 inch stroke is less than half the 10 inch stroke required of the know forming mandrel, the speed and, hence, the production of the machine has been significantly increased.

While the rotary member is disclosed as rotating through 180°, it should be understood that it could have four equiangularly-spaced slots 50 and mandrel sections 43 and be rotated 90° for each cycle.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents therefo:

I claim:

1. Carton forming apparatus comprising:

an endless chain having spaced lugs for feeding carton blanks;

a rotary former rotatably mounted at the downstream end of said endless chain;

said former having means to grasp a carton blank and a mandrel over which said carton blank is partially formed;

arcuate plows overlying said former in a position to engage said carton blank and effect partial folding of it as said former rotates through 180°;

a hopper located downstream of said former for receiving completed cartons;

and a kicker bar mounted at the downstream side of said rotary former, means connected to said kicker bar for reciprocating said kicker bar to engage the trailing edge of a carton blank and thrust it into said hopper;

said former having two slots on diametrically-opposite sides thereof;

each slot defining, in part, said mandrel adjacent said slot;

said slot forming said blank-grasping means.

2. Apparatus as in claim 1 further comprising a pair of side bars mounted on opposite sides of said mandrel and creating a flared gap between said mandrel and side bars to receive and hold down lateral portions of said carton blank as said former rotates.

3. Apparatus as in claim 2 further comprising:

side plows alongside said chains to plow down the lateral portions of said blank prior to the blank's being thrust into said former.

4. Carton forming apparatus comprising:

an endless chain having spaced lugs for feeding carton blanks;

a rotary former rotatably mounted at the downstream end of said endless chain;

said former having means to grasp a carton blank and a mandrel over which said carton blank is partially formed;

arcuate plows overlying said former in a position to engage said carton blank and effect partial folding of it as said former rotates through 180°;

a hopper located downstream of said former for receiving completed cartons;

and a kicker bar mounted at the downstream side of said rotary former, means connected to said kicker bar for reciprocating said kicker bar to engage the trailing edge of a carton blank and thrust it into said hopper;

said rotary former comprising:

a pair of spaced plates mounted on a shaft;

each plate having, on opposite sides of said shaft, a mandrel section and retainer section, said two sections being spaced apart to form a blank-grasping slot;

each mandrel section having a side bar mounted to its surface and having a portion spaced therefrom to receive a lateral portion of a blank.

* * * * *